United States Patent [19]

Peham

[11] Patent Number: 4,709,422

[45] Date of Patent: Dec. 1, 1987

[54] SNAP ACTION HINGED SUPPORT FOR A COLLAPSIBLE TOP HAT

[76] Inventor: Engelbert J. Peham, 1302 Eleanor Ave., St. Paul, Minn. 55116

[21] Appl. No.: 918,083

[22] Filed: Oct. 14, 1985

[51] Int. Cl.[4] ..... A42B 1/20

[52] U.S. Cl. ..... 2/180

[58] Field of Search ..... 2/180, 175, 209.1, 196, 2/185 C, 185 B

[56] References Cited

U.S. PATENT DOCUMENTS 207,353 8/1878 Harrington ..... 2/180

535,912 3/1895 Langhammer ..... 2/180

857,434 6/1907 Behringer ..... 2/180

*Primary Examiner*—Peter Nerbun

*Attorney, Agent, or Firm*—Jacobson and Johnson

[57] ABSTRACT

In a collapsible top hat which can be used as a novelty item or for formal wear, elongated plastic support members are attached between the brim and the crown of the hat along the riser, each of the support members having a medial hinge formed by a transverse slit so that they can swing apart or fold together as the hat is extended and collapsed and an attached resilient member to snap and hold the support member in the swung apart or folded condition when the hat is extended or collapsed.

8 Claims, 5 Drawing Figures

SNAP ACTION HINGED SUPPORT FOR A COLLAPSIBLE TOP HAT

FIELD OF THE INVENTION

The invention is intended for use with a collapsible top hat which can be utilized as a novelty item or for formal attire. More specifically, the invention is directed toward providing hinged support elements between the brim and the crown of the hat along the riser which will snap and hold the hat riser in the extended and collapsed condition.

DESCRIPTION OF THE PRIOR ART

While snap action top hats have been around for many years and utilize hinged support elements attached between the brim and the crown along the riser to permit the hat to be snapped and held in the extended and collapsed condition, these elements are combinations of wire springs and bails which are connected together in complex fashion so that the supports are costly to make and attach thereby making the hat itself quite costly. Also, the support members resting on the inside of the riser of the hat can make the hat uncomfortable to the wearer.

SUMMARY

The preferred embodiment of the present invention utilizes four equally spaced elongated plastic support members inside the riser of the hat extending between the inner edge of the brim and about the outer edge of the crown. Each support member is integrally formed out of a single length of plastic with transverse slits suitably located on the members to provide hinges so that the members can be extended to their full length to put and hold the riser in the extended condition or can be folded to put and hold the riser in the collapsed condition. Each support member has a medial transverse slit which defines two legs which are hinged together and a resilient member, such as an "O" ring or a spring, attached to each leg across the medial slit. When the two legs are folded together about the medial slit or hinge, at a critical hinge angle, the resilient member snaps and holds the two legs together in a fully folded condition so that the riser is collapsed for storage. When the legs are unfolded and the critical angle is reached the resilient member acts to snap and hold the legs in their fully extended condition so that the hat riser is fully extended and ready for wear. The elongated support members and the accompanying resilient member are relatively simple in construction and since the support member is a single plastic piece, it is relatively inexpensive to produce and does not cause any discomfort to the wearer.

DESCRIPTION OF THE PREFERRED EMBODIMENT

Figure 1:
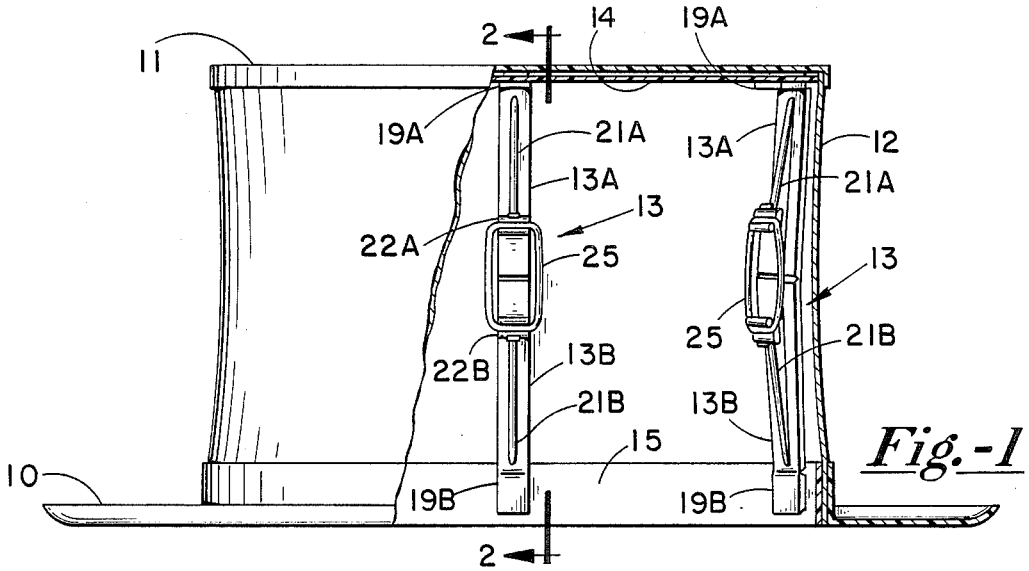
FIG. 1 is a partially sectioned view of a top hat in the extended condition illustrating a preferred embodiment of the invention.
Figure 2:
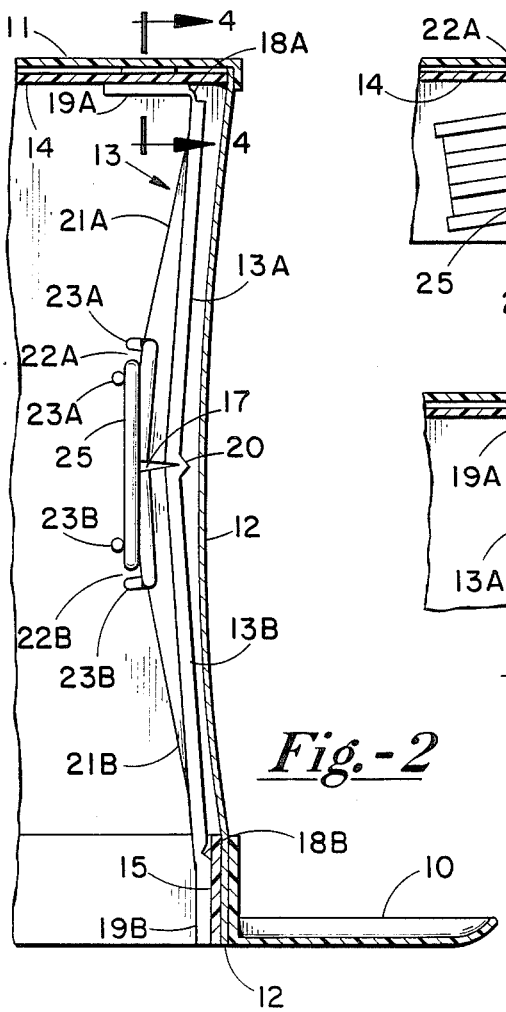
FIG. 2 is an enlarged sectioned view of the hat in the extended condition showing an embodiment of the invention in greater detail.
Figure 3:
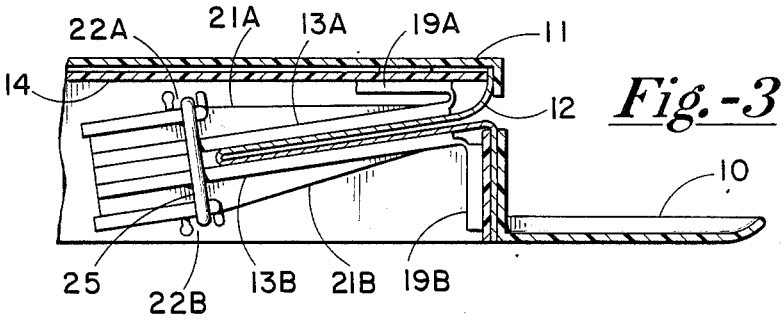
FIG. 3 is a sectioned view showing details of the invention with the top hat in the collapsed condition.

A typical and conventional top hat has a stiff annular oval-shaped brim 10, a flat top or crown 11 and a riser 12 between the crown and the brim. Typically and conventionally the brim and crown are usually covered with some suitable fabric such as a felt-like material and the riser is a suitable fabric material which is attached in some convenient fashion, such as by adhesive or stitching, at one end to the outer edge of the crown 11 and at the other end to the inner or annular edge of the brim 10. To hold the hat in the extended condition, as illustrated in FIGS. 1 and 2 and to make the hat collapsible, as illustrated in FIG. 3, a number of elongated support members generally designated by reference numeral 13, located just inside the riser 12, extend between the brim 10 and the crown 11. The preferred embodiment utilizes four support members 13 equally spaced from one another around the interior of the riser. The crown is provided with a thin stiffener plate 14 which is oval-shaped to conform to the shape of the crown and a stiff retainer band 15 is attached on edge around the annular edge of the brim 10 inside the riser 12.

All of the support members 13 are identical to one another and each is made out of a single integrated molded strip of plastic. At about the center of the strip of plastic a slit 17 extends completely across but only partway through the plastic to define a pair of legs 13A and 13B which are hinged together by the remaining plastic at 20. Near but spaced from the distal end of each of the legs 13A and 13B are similar cross or transverse slits 18A and 18B which define foot members 19A and 19B which are hingedly joined to leg members 13A and 13B respectively by the remaining plastic at the slits 18A and 18B, respectively. Foot 19A is attached to and rests against the underside of stiffener plate 14 and foot member 19B is attached to and rests against the inner side of retainer band 15. When the hat or riser is in the fully extended condition, as illustrated in FIGS. 1 and 2, the ends of the legs 13A and 13B at the medial hinge 20 are substantially in butting relationship; foot 19A is bent or hinged at about 90° from leg 13A; and foot 19B is substantially in line with leg 13B. In the collapsed condition, as illustrated in FIG. 3, legs 13A and 13B are folded over one another and leg 13B and foot 19B are at about a 90° relationship. Also in the folded condition it can be observed that the fabric of riser 12 is folded inward between the two legs 13A and 13B.

The side of support member 13 which faces risers 12 is flat except for slits 18A and 18B and a dimple at hinge 20 opposite slit 17 which provides the connection between the two legs 13A and 13B. On the inward facing side of support 13, each of the legs 13A and 13B have narrow ramps 21A and 21B, respectively, which taper upward from just inside respective slits 18A and 18B toward the medial slit 17. At about the top of ramps 21A and 21B are transverse channels 22A and 22B, respectively, formed by ridges 23A and 23B, respectively. Resting within the channels 22A and 22 B extending over the medial hinge connection 20 between legs 13A and 13B is a resilient member 25 preferably in the form of a rubber O-ring. When the hat and the support member 13 are in the fully extended condition, as illustrated in FIGS. 1 and 2, the resilient member 25 is taut and holds the ends of legs 13A and 13B at medial hinge 20 in butting relationship so that the support member holds the hat and the riser in the fully extended condition. When the hat is in the collapsed condition, FIG. 3, the resilient member 25 is taut to hold the legs 13A and 13B folded together.

To fold or collapse the hat from its fully extended condition, firm hand pressure is applied downward on the top or crown to cause the two legs 13A and 13B to pivot inward about the medial hinge 20 and when the angle between the two legs at hinge 20 reaches a certain critical value, the resilient member 25 acts to snap the two legs into their completely folded condition as illustrated in FIG. 3. Correspondingly, if the hat is initially collapsed it is extended by pushing firmly against the underside of the crown to unfold the legs 13A and 13B of the support member 13 and when the same critical angle is reached or just exceeded, the resilient member 25 acts to snap the support member 13 into the fully extended condition by bringing the two legs 13A and 13B into end-to-end butting relationship at the medial hinge 20, as illustrated in FIG. 2. Another way of extending the hat from the folded or collapsed condition is to grasp the brim 10 on opposite sides of the riser 13 with both hands and with a quick thrust, force the crown away from the brim far enough so that the critical angle mentioned previously is reached and just exceeded and the resilient member 25 then acts to snap the riser 12 into the fully extended condition.

Figure 4:
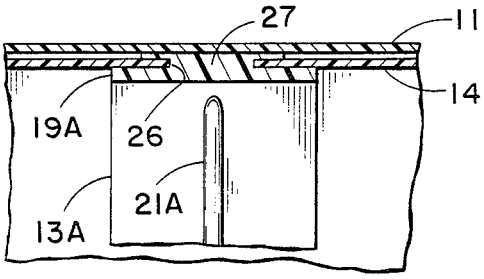
FIG. 4 is a sectioned view showing detail of a manner of attaching the support member.

Foot members 19A and 19B can be secured respectively to the crown stiffener plate 14 and the retainer band 15 in any convenient fashion. One manner of securing foot 19A, as illustrated in FIG. 4, is by providing a narrow slot 26 extending inward from the edge of stiffener plate 14 which engages a short pedestal 27 which is formed on the side of foot member 19A facing the crown or top of the hat. Foot member 19B can be attached to retainer band 15 in a similar fashion or both foot members can be attached in other fashions.

While not shown in the drawings for clarity, normally a lining is provided between the crown and the brim to cover over the support members.

Figure 5:
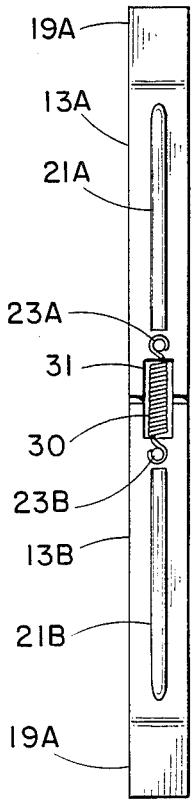
FIG. 5 illustrates an alternate resilient member for holding the hat extended and/or collapsed.

An alternate embodiment of the invention is illustrated in FIG. 5. Instead of an "O" ring, a spiral spring 30 is engaged at each end to ridges 23A and 23B and stretches across the medial slit 17. A generally rectangular opening 31 through legs 13A and 13B may be necessary to keep spring 30 from being disengaged from ridges 23A or 23B when the legs are folded together and held in that condition by spring 30. Spring 30 operates to snap and hold the support member in the fully extended condition and in the folded condition in a fashion similar to that of "O" ring 25.

I claim:

1. In a collapsible top hat having a flat generally oval shaped top or crown, an oval shaped annular brim and a collapsible riser between the outer edge of the crown and the annular edge of the brim;

(a) a thin, generally oval shaped plate stiffener in the crown of the hat;

(b) a narrow, thin, stiff retainer band resting on edge along the inner annular edge of the hat brim;

(c) a plurality of extendible and foldable snap-action support members attached between said crown stiffener and said retainer band spaced apart around the hat riser, each of said support members comprising a pair of identical elongated leg members hindgedly attached together at one end and each having a hingedly attached foot member at the other end;

(d) means for attaching the foot on one of said legs to said stiffener plate;

(e) means for attaching the foot on the other of said legs to said retainer band; and (f) resilient means coupled to each of said legs across said first mentioned hinge attachment for holding the ends of said legs at said hinge attachment abutting one another when the hat riser is extended and for holding said legs folded together when said hat riser is collapsed.

2. The invention as described in claim 1 wherein the resilient means acts to snap and hold the legs into end-to-end abutment at said first mentioned hinge attachment when the hinge attachment angle just exceeds a critical value and to snap and hold the legs folded together when the hinge attachment angle is less than the critical value.

3. The invention as in claim 1 wherein said resilient means comprises a resilient "O" ring engaged with each leg near but removed from said first mentioned hinge attachment.

4. The invention as in claim 1 wherein said resilient means comprises a resilient spring member engaged with each leg near but removed from said first mentioned hinge attachment.

5. In a collapsible top hat having a flat generally oval shaped top or crown, an oval shaped annular brim and a collapsible riser between the outer edge of the crown and the annular edge of the brim;

(a) a thin, generally oval shaped plate stiffener in the crown of the hat;

(b) a narrow, thin, stiff retainer band resting on edge along the inner annular edge of the hat brim;

(c) a plurality of extendible and foldable snap-action support members attached between said crown stiffener and said retainer band spaced apart around the hat riser, each of said support members comprising an elongated integral stiff plastic strip having a medial transverse slit defining a pair of indentical extending legs hingedly attached together by a medial hinge, each of said legs having a transverse slit near its distal end defining a hingedly attached foot at the distal end of each of said legs;

(d) means for attaching the foot on one of said legs to said stiffener plate;

(e) means for attaching the foot on the other of said legs to said retainer band; and (f) resilient means coupled to each of said legs across said medial transverse slit for holding the ends of said legs at the medial hinge abutting one another when the hat riser is extended and for holding said legs folded together when said hat riser is collapsed.

6. The invention as described in claim 5 further including a transverse ridge formed on each of said legs near but displaced from said medial hinge, said resilient means being engaged with said ridges.

7. The invention as in claim 5 wherein said medial slit is on one side of said support member and said distal end slits are on the other side of said support member.

8. The invention as in claim 7 wherein each of said leg members has a ramp on the same side of the support member as said medial slit, said ramp tapered upward from near said distal end slits toward said medial slit, said resilient means being coupled to each leg at about the high point of said ramp.

* * * * *